US007003810B2

(12) United States Patent
Goldkind

(10) Patent No.: US 7,003,810 B2
(45) Date of Patent: Feb. 28, 2006

(54) NOVELTY JEANS

(75) Inventor: Tina Goldkind, Huntington, NY (US)

(73) Assignee: Swirl Design, Inc., Holbrook, NY (US)

( * ) Notice: Subject to any disclaimer, the term of this patent is extended or adjusted under 35 U.S.C. 154(b) by 0 days.

(21) Appl. No.: 10/909,766

(22) Filed: Aug. 2, 2004

(65) Prior Publication Data

US 2005/0000001 A1 Jan. 6, 2005

Related U.S. Application Data

(62) Division of application No. 10/098,856, filed on Mar. 14, 2002, now Pat. No. 6,769,139.

(51) Int. Cl.
*A41D 11/00* (2006.01)

(52) U.S. Cl. ..... 2/227; 2/80

(58) Field of Classification Search ..... 2/48, 2/49.1, 69, 69.5, 75, 77, 80, 111, 115, 238, 2/227, 228, 244–254; 446/26–28
See application file for complete search history.

(56) References Cited

U.S. PATENT DOCUMENTS 1,116,128 A * 11/1914 Rudloff ..... 2/253
1,764,483 A * 6/1930 Watkins ..... 2/247
2,383,217 A 8/1945 Schaffer
2,593,218 A 4/1952 Swain
2,628,452 A 2/1953 Gladstein
2,663,876 A 12/1953 Miller et al.
2,883,673 A 4/1959 Solomon
2,986,743 A 6/1961 Eilen
3,246,343 A * 4/1966 Gilligan ..... 2/250
3,308,479 A 3/1967 Sesco, Jr.
3,320,620 A * 5/1967 Weidler et al. ..... 2/250
3,371,829 A 3/1968 Phillips
3,447,165 A 6/1969 Brosk
4,123,804 A 11/1978 Michael et al.
4,138,745 A 2/1979 Greenspan
4,553,269 A * 11/1985 Nowak ..... 2/254
D281,636 S * 12/1985 Cressy-Renoma ..... D2/742
4,651,355 A 3/1987 White
4,710,979 A 12/1987 Bull et al.
4,723,323 A 2/1988 Wright, Jr.
4,898,404 A * 2/1990 Babcock ..... 281/15.1
4,975,987 A * 12/1990 Teachout et al. ..... 2/246
5,054,127 A 10/1991 Zevchak
5,121,505 A 6/1992 Ludmer et al.
5,173,968 A 12/1992 Fox
5,209,691 A 5/1993 Ekstein
5,210,881 A 5/1993 Stocker, Jr. et al.
5,222,259 A 6/1993 Bristor
5,312,282 A 5/1994 Cooper
5,394,565 A 3/1995 Stewart et al.
5,421,032 A 6/1995 Murphy
5,468,152 A * 11/1995 Lenart ..... 434/429

(Continued)

*Primary Examiner*—Alissa L. Hoey
(74) *Attorney, Agent, or Firm*—Schweitzer Cornman Gross & Bondell LLP

(57) ABSTRACT

Novelty play jeans for children which include one or more active play features usable while the jeans are being worn. These various features include, but are not limited to a race course for a toy race car, a concealed pocket extractable to form a flag-like decoration, a window pocket, a secret tunnel pocket, a carry pouch convertible into a flat play area, and concealed knee pockets which enable the user of jeans to display a puppet show using built-in features of the jeans, while worn by the user.

3 Claims, 10 Drawing Sheets

U.S. PATENT DOCUMENTS 5,509,147 A 4/1996 Busquets
5,516,321 A 5/1996 Kornbleuth
5,517,696 A 5/1996 Krugler
5,542,122 A 8/1996 Moldovan
5,566,391 A 10/1996 Williamson
5,669,078 A * 9/1997 Scremin et al. ..... 2/247
5,734,991 A 4/1998 Schmid
5,813,584 A 9/1998 Mauser
5,842,230 A 12/1998 Laudick
5,884,338 A 3/1999 Golde
5,894,600 A 4/1999 Chenefront
5,901,372 A 5/1999 Lawler
5,933,866 A 8/1999 Fox
5,960,476 A 10/1999 Danzy
6,038,698 A 3/2000 Lawler
6,126,507 A 10/2000 Lieberman
6,131,205 A 10/2000 Arem
6,151,715 A 11/2000 Doherty
6,167,572 B1 * 1/2001 Naumovitz ..... 2/227
6,182,296 B1 2/2001 Hosogai
6,199,218 B1 * 3/2001 Michael ..... 2/247
6,202,220 B1 3/2001 Rhoden
6,233,747 B1 5/2001 Barker
6,305,027 B1 * 10/2001 Chou ..... 2/227
6,311,335 B1 11/2001 Uchida
6,839,915 B1 * 1/2005 Yoshimura ..... 2/250

* cited by examiner

FIG. 9
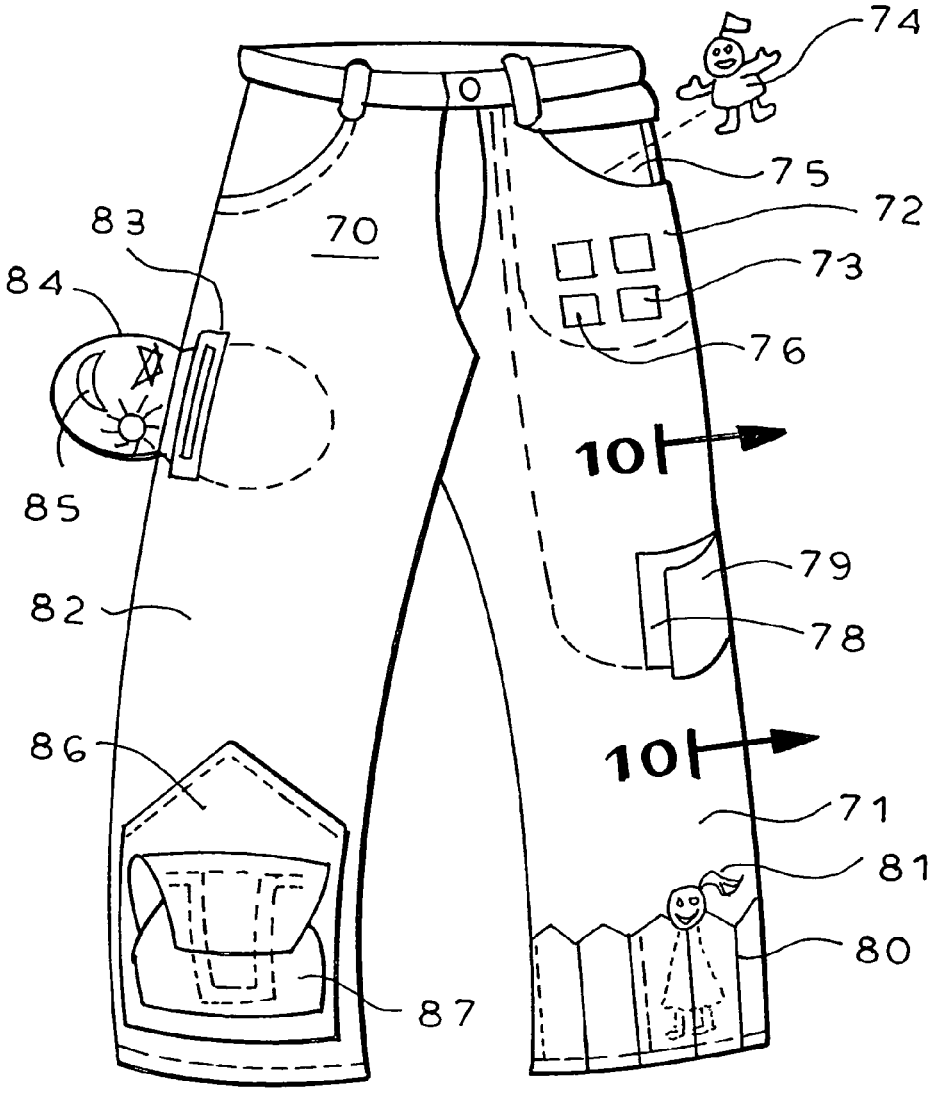
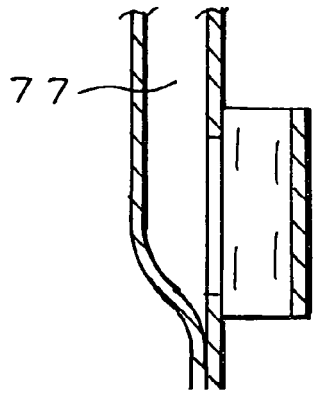
FIG. 10

FIG. 11
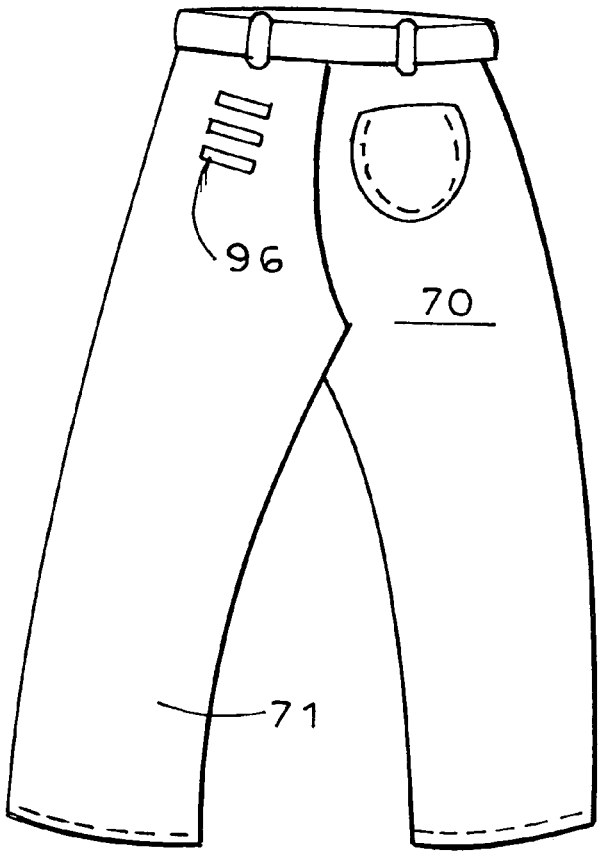
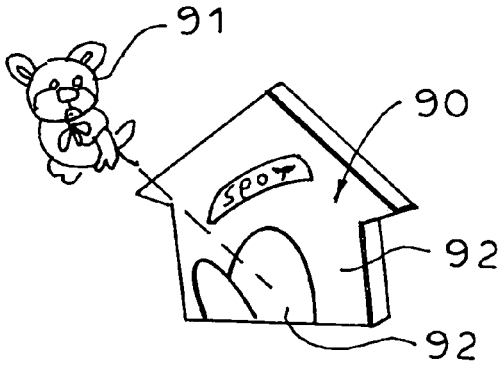
FIG. 12
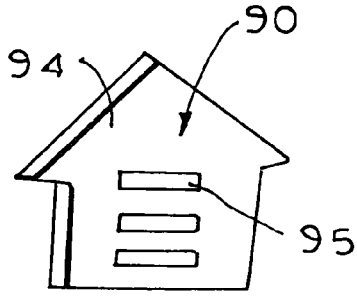
FIG. 13

NOVELTY JEANS

RELATED APPLICATIONS

This application is a divisional of my application Ser. No. 10/098,856, filed Mar. 14, 2002, now U.S. Pat. No. 6,769,139, granted Aug. 3, 2004.

BACKGROUND OF THE INVENTION

The invention is directed to the field of children's wear and in particular to children's jeans incorporating auxiliary features providing play activities for the user. Children's clothing items having play facilities are, in general, known. For example, the Stocker, Jr. et al. U.S. Pat. No. 5,210,881 and Lawler U.S. Pat. No. 6,038,698 disclose shirts with special pockets for removable reception of toy animals. Stewart et al. U.S. Pat. No. 5,394,565 shows a jacket which, when removed from the wearer and placed flat on a support surface, forms a game-playing surface. The Kornbleuth U.S. Pat. No. 5,516,321 illustrates a sleeve construction incorporating a puppet feature at the end. The present invention represents a significant improvement over these representative types of garments in providing children's play features that are much more attractive and exciting to the user during play, while also imparting a novel and attractive appearance to the garment.

SUMMARY OF THE INVENTION

The invention relates to novelty jeans for children which, while having a basic child's jeans construction, incorporate a variety of interesting and attractive features enabling the user, while wearing the jeans, to have a variety of play outlets derived from special features incorporated in the jeans.

In one preferred form of the invention, sometimes referred to herein as "racetrack" jeans, one or both of the legs of the jeans may be provided with a contoured racetrack running generally vertically from top to bottom along the front of the leg, defining a racetrack for a toy race car, which preferably is provided as a package with the jeans. The jeans may be provided with a panel of fabric or other material spanning the defined track and secured to the jeans leg at opposite sides of the track, forming a tunnel through which the toy car can be driven by the user. In association with the defined racetrack, the jeans leg may be provided with a partially hidden, laterally opening "pocket". The user can insert his or her hand into this "pocket" and invert it by pulling the pocket-defining pouch out through the pocket opening. The inside surface of the pocket-forming pouch carries a preprinted design, such as a black and white checkered design representative of a race flag, for example. All of the above described features are provided along the front portions of the jeans leg, where they are readily accessible to the wearer of the jeans, for play while the jeans are being worn.

In a particularly advantageous form of the above described "race track" jeans, the racetrack features may be provided on one leg, and a series of special pocket features provided on the opposite leg. The special pocket structure advantageously includes a first pocket of typical dimensions for receiving, among other things, the toy race car provided with the jeans. Preferably, that pocket is formed with a clear "window" panel, such that the toy car or other object is at least partially visible through the front wall of the pocket. Behind the first pocket is a "secret" pocket, which forms an internal tunnel extending well down the inside of the leg of the jeans and formed with an exit opening at or near the bottom of the pocket, such that, as a play feature, the toy car or other play object may be moved downward through the secret pocket and extracted through the lower opening.

In various of its forms, the novelty jeans of the invention may advantageously incorporate a convertible carry pouch, formed of fabric or other flexible material, which is removably carried on one of the legs of the jeans, preferably near the bottom. The pouch advantageously is formed of a single piece of material, provided with a main back panel and four foldable panels securable by Velcro or other hook and loop fastening elements. When closed by folding and securing the foldable panels over the front of the back panel, the pouch forms a container for play articles. When removed from the jeans leg, the pouch can be opened flat to provide a separate play surface.

In a further advantageous form of the invention, sometimes referred to herein as "dollhouse" jeans, a pair of child's jeans is advantegously provided with a variety of features suitable for playing with one or more small dolls, while the jeans are being worn by the child. In an illustrative form, the jeans can include on one leg a folded pouch, of the type generally described above, secured to a lower portion of the leg against a background of a dollhouse. Adjacent the bottom of the opposite leg, the jeans may be provided with an open top pocket in the form of, for example, a fence, providing a play pocket behind which a small doll can be placed and carried while being partly visible over the top of the fence. The dollhouse jeans also advantageously includes a special pocket structure including a "secret" tunnel pocket having an outlet at the bottom, and a window pocket in which a doll can be placed and viewed from the front. Features such as a laterally opening pocket, which converts into a flag or the like when withdrawn, can also be incorporated in the "dollhouse" jeans.

Yet another preferred embodiment of the invention incorporates special play features in the area of the knee portions of the jeans, including such features as a sliding curtain, which can be opened to reveal a "stage", and hidden pockets containing finger puppets. The finger puppets can be activated by the user's hands, to be projected out of the hidden pockets and manipulated in front of the "stage", all while the jeans are being worn by the user.

Some of the features generally described above can be mixed and matched, as can be appreciated. Additionally, the jeans can be provided with removable special pockets, containing or associated with additional dolls or animals, for example, such that highly attractive and exciting jeans sets may be provided.

For a more complete understanding of the above and other features and advantages of the invention, reference should be made to the following detailed description of preferred embodiments of the invention, and to the accompanying drawings.

DESCRIPTION THE DRAWINGS

FIG. 9 is a front elevational view of a second preferred form of the invention, referred herein as dollhouse jeans, which incorporates features enabling the user to engage in doll play while wearing the jeans.

FIG. 10 is a fragmentary cross sectional view as taken generally on line 10—10 of FIG. 9.

FIG. 11 is a back elevational view of the jeans of FIG. 9 illustrating features for the removable attachment of a play device.

FIG. 12 is a front perspective view illustrating a doghouse type play device useful with the jeans of FIG. 11.

FIG. 13 is a back perspective view of the device of FIG. 12 illustrating features for attachment to the jeans of FIG. 11.

DESCRIPTION OF PREFERRED EMBODIMENTS

Figure 1:
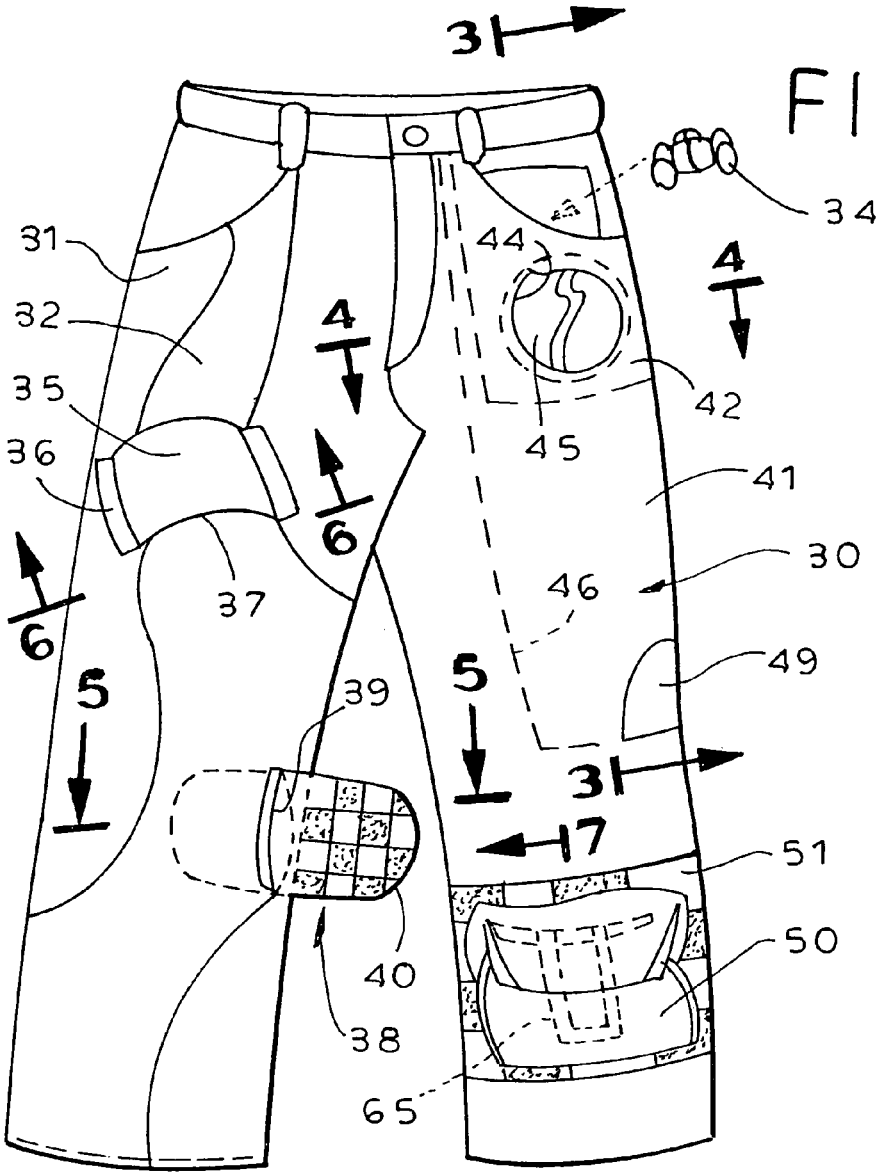
FIG. 1 is a front perspective view of one preferred form of the novelty jeans, sometimes referred to as racetrack jeans.

Referring now to the drawings, and initially to FIGS. 1–8 thereof, the reference numeral 30 designates generally a pair of children's jeans which may in many respects be of conventional construction, but are significantly modified pursuant to the invention. In the illustrated embodiment, the right leg 31 of the jeans is provided with a defined path 32 extending from the upper area of the leg in a serpentine pattern generally to the lower end of the leg. Preferably, this serpentine path is formed by attaching a separate layer of material, such as a layer of leather-like material 33 (FIG. 6) which is attached to the fabric material of the jeans leg 31. In accordance with the invention, the defined path 32 forms a "racetrack", on which the user of the jeans, while wearing them, may play with a small toy race car 34, which is preferably marketed as part of the jeans sales item.

To advantage, a panel 35 of fabric or other material (FIG. 6) is attached to the front of the jeans leg at spaced points 36 on opposite sides of the racetrack. This forms a tunnel 37 through which the car 34 may be driven during play.

Figure 5:
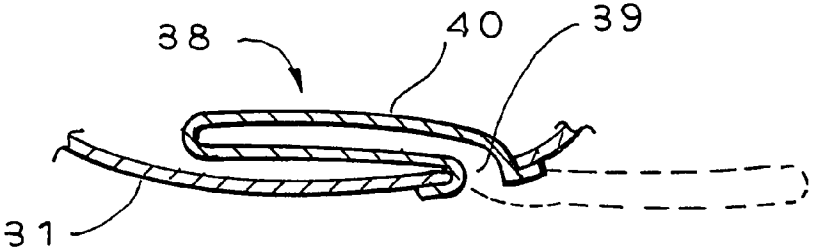
FIG. 5 is an enlarged fragmentary cross sectional view as taken generally on line 5—5 of FIG. 1.

In accordance with another aspect of the invention, the jeans are provided, in this case on the right leg 31, with a special lateral pocket feature, designated generally by the reference numeral 38, additional details of which are illustrated in FIG. 5. A pocket opening 39 is formed in the lower portion of the jeans leg 31. However, the pocket is not designed to hold anything, and the pocket opening is oriented vertically. A pocket pouch 40 is secured around the edges of the pocket opening 39. When not in "use" the pocket pouch 40 is positioned on the inside of the jeans leg 31, in the manner indicated in FIG. 5.

Pursuant to the invention, the pocket pouch 40 is provided with decorative indicia (printed or otherwise) on the inside surface thereof. Thus, when the pocket is pulled inside out, as shown in FIG. 1, a decorative "flag" is displayed along an edge of the racetrack 32. In the illustrated arrangement, the decorative flag advantageously is in the form of a checkered race flag, for example. When the child is through with a game's playing session, the pocket pouch 40 can be returned to its retracted and concealed position, as shown in FIG. 5.

In accordance with another aspect of the invention, the play jeans are provided with novel pocket features which accommodate a variety of play action by the user of the jeans while wearing them. In the form of the invention illustrated in FIG. 1, the left leg 41 of the jeans is provided with a window pocket 42, which is formed by securing a pocket panel 43 to the inside of the jeans leg (see FIG. 3). An opening 44 is formed in the front of the pocket, and this is closed off by a transparent window panel 45. The user of the jeans thus can place the race car 34 or other associated toy into the window pocket, making it at least partially visible to play mates.

Figure 3:
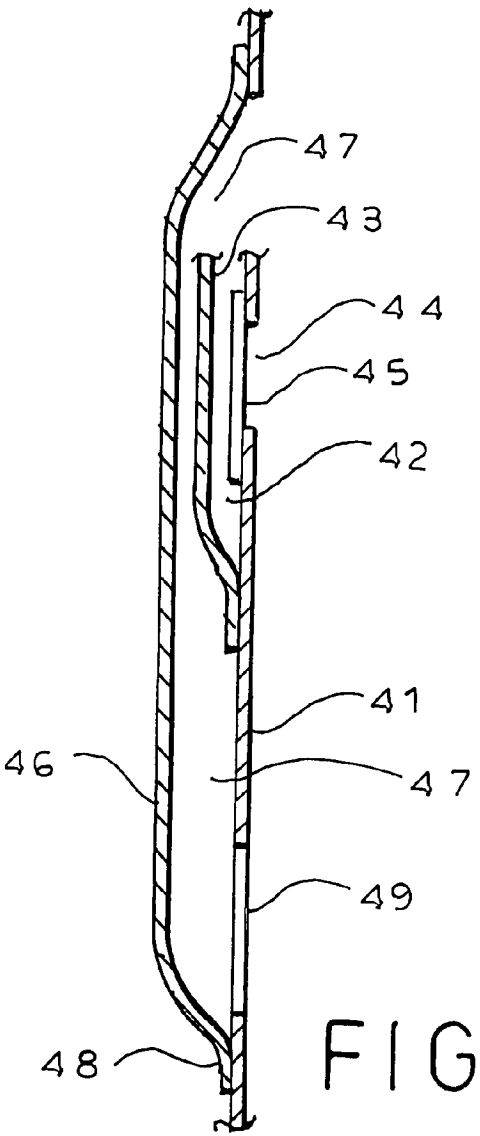
FIG. 3 is an enlarged fragmentary cross sectional view, as taken generally on line 3—3 of FIG. 1.
Figure 6:
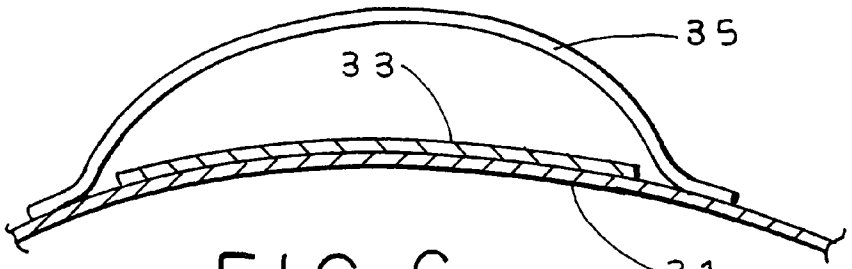
FIG. 6 is an enlarged fragmentary cross sectional view as taken generally on line 6—6 of FIG. 1.

In the play jeans of the invention, a secret tunnel pocket is also provided in the left leg 41, behind the window pocket 42. This is formed by securing a vertically elongated panel of fabric 46 (FIG. 3) to the inside of the jeans leg 41, extending from the main pocket opening 47 to a point well below the window pocket 42, typically slightly above the knee. As indicated in FIG. 3, the tunnel pocket 47 is closed at its lower end 48. However, an opening 49 is provided at the lower extremity of the tunnel pocket. This allows a toy device 34, inserted into the tunnel passage through the pocket opening 47 at the top, to be passed downwardly through the tunnel and removed through the lower opening 49, all while wearing the jeans.

In a particularly preferred form, the play jeans of FIG. 1 incorporate a carry pouch feature in the form of a small pouch 50 removably carried on the left jeans leg 41 near the bottom. Preferably, the pouch 50 is mounted against a patch of decorative background 51 attached to the front of the jeans leg and decorated appropriately according to the theme of the jeans, in this case in the form of a race flag.

Figure 8:
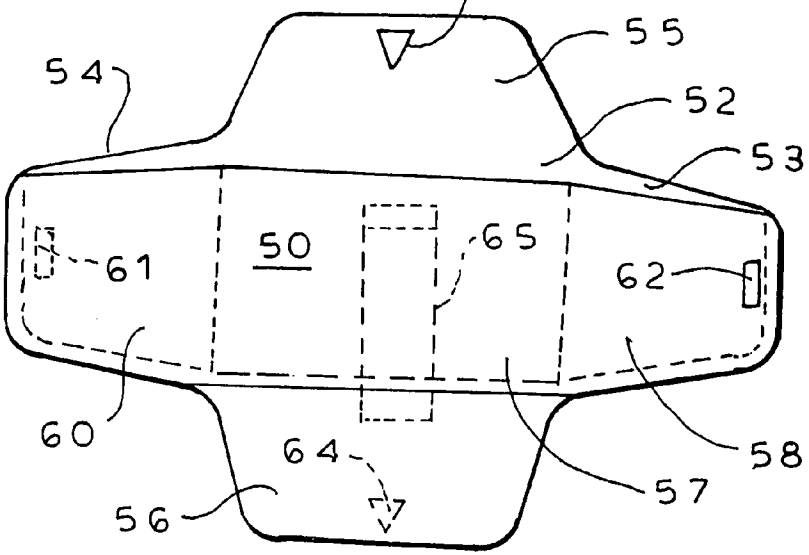
FIG. 8 is a plan view of a foldable pouch device utilized in the jeans of FIG. 1, illustrating the pouch in open form.

The pouch 50, shown in an open form in FIG. 8, is comprised of a back panel 52 of generally rectangular form. The pouch is formed of flexible material, for example cloth, and includes end panels 53, 54 extending from opposite side edges of the back panel, and upper and lower panels 55, 56 extending from upper and lower edges respectively of the back panel 52. To advantage, an inside panel 57 may be secured to the back panel 52 and end panels 53, 54 to form separate pockets 58–60.

The pouch is closed by folding the end panel 54 over the back panel 52 and then folding the opposite end panel 53. The two end panels advantageously may be secured in their folded configuration by means of Velcro or other hook and loop fasteners 61, 62. The bottom panel 56 may then be folded upward over the folded end panels, and then the upper panel 55 folded down over the lower panel 57. The upper and lower panels may be secured by suitable means, conveniently hook and loop fastener elements 63, 64. The folded pouch is illustrated in end view in FIG. 7.

Figure 7:
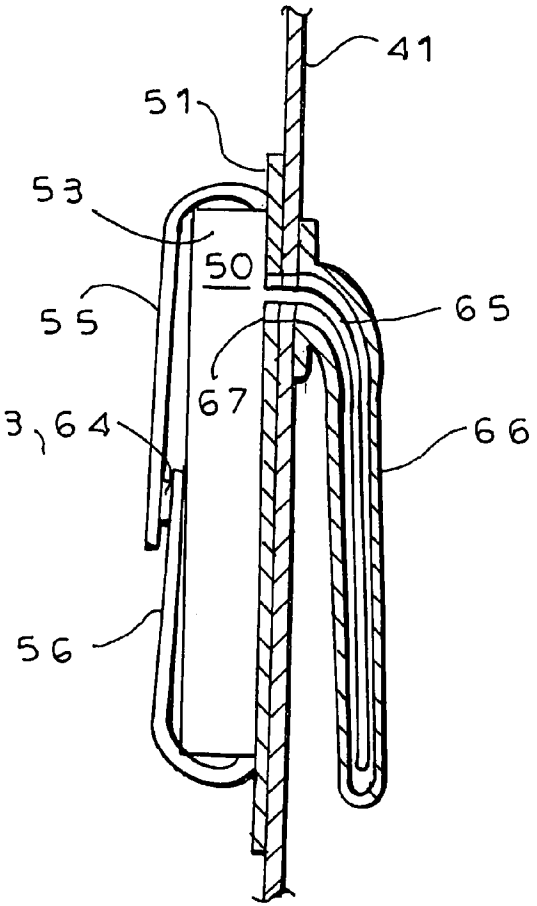
FIG. 7 is an enlarged fragmentary cross sectional view as taken generally on line 7—7 of FIG. 1.

Desirably, the pouch 50 is removably attached to the jeans leg 41 to facilitate access. Additionally, when the pouch is removed and opened flat, it provides a separate play facility. Removal attachment can be accomplished by means of hook and loop fasteners (not shown) for example. In the preferred embodiment of the invention, however, the pouch is removably attached by means of an extended tongue 65 which is secured to the back panel 52 of the pouch and extends downward, generally as shown in FIGS. 7 and 8. The tongue 65 is made out of a material having some degree of stiffness. It may be fabric, in which case a stiffener material is incorporated within the structure of the tongue. A narrow deep pocket 66 is attached to the inside of the jeans leg 41, as shown in FIG. 7, and is aligned with openings 67 in the jeans leg 41 and the decorative patch 51.

For wear-around use, the pouch 50 is closed and the extended tongue 65 is inserted into the pocket 66, mounting the pouch in the manner shown in FIG. 1. It may be easily removed at any time by withdrawing the tongue 65 from the pocket 66. It may be then carried as a closed pouch, or laid open in the manner shown in FIG. 8 and used as a play surface or the like. For the latter use, the inside surfaces of the pouch may be suitably decorated.

The various features thus far described are incorporated in the racetrack jeans illustrated in FIG. 1. However, as will be understood, and as will be made clear hereinafter, many of the features incorporated in the jeans of FIG. 1, may be utilized as well in other types of jeans having other play themes.

In a second preferred embodiment of the invention, shown in FIGS. 9–13, a set of play jeans 70, hereinafter referred to as dollhouse jeans, may be comprised in part of a set of standard children's blue jeans, modified and adapted in accordance with the invention. In the dollhouse jeans, the left jeans leg 71 advantageously is provided with a window pocket 72, which can be of the same general construction as the window pocket 42 of the FIG. 1 embodiment. For the dollhouse jeans, however, the window opening 73 advantageously is in the form of four small rectangular cut-outs, giving the sense of a house window with several window panes, and the outside of the pocket may be suitably decorated with curtains or other window treatments (not shown) for decorative purposes.

One or more doll FIGS. 74, which may be marketed as a package with the jeans 70, can be received in the window pocket 75 and are thus at least partially visible through window panes 76 formed of a clear material sewed onto the inside of the window pocket, in the manner of the clear panel 45 of FIG. 3. A secret tunnel pocket 77 (FIG. 10) is provided behind the window pocket 75, in the same manner as the secret tunnel pocket 47, shown in FIG. 3, provided in the embodiment of FIG. 1.

Whereas the secret tunnel pocket of FIG. 1 is shown with a plain opening 49, the tunnel pocket 77 of the dollhouse jeans advantageously may be provided with an opening 78 provided with a door flap 79 secured at one side and partially concealing the opening 78.

At the bottom of the left jeans leg 71 there are provided one or more pocket compartments defined by a pocket front panel 80 attractively formed in the manner of a board fence. The panel 80 is secured along its side and bottom edges, forming one or more upwardly opening pocket compartments for the reception of doll FIGS. 81 or the like.

The right leg 82 of the dollhouse jeans is provided with a lateral pocket feature 83. This corresponds in structure to the pocket feature 38 of the FIG. 1 embodiment, in that a pocket pouch 84, normally positioned inside the jeans leg 82, can be pulled laterally outward and allowed to hang out in the form of a flag, substantially as shown in FIG. 9. The inside surface of the pocket pouch 84 is provided with suitable decorations 85, which are visible when the pocket is turned "inside out" and displayed as in FIG. 9.

Figure 2:
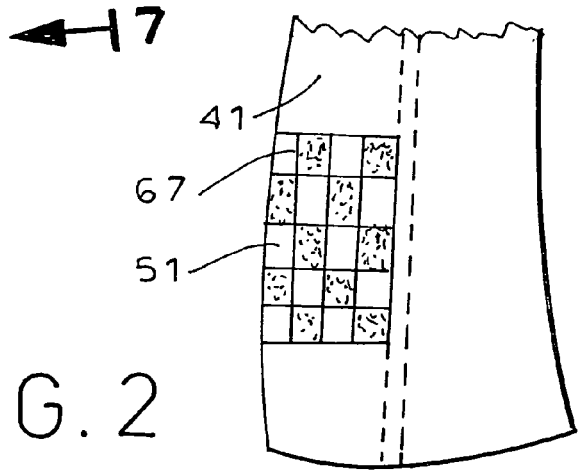
FIG. 2 is a fragmentary side elevational view of one of the legs of the jeans of FIG. 1.
Figure 4:
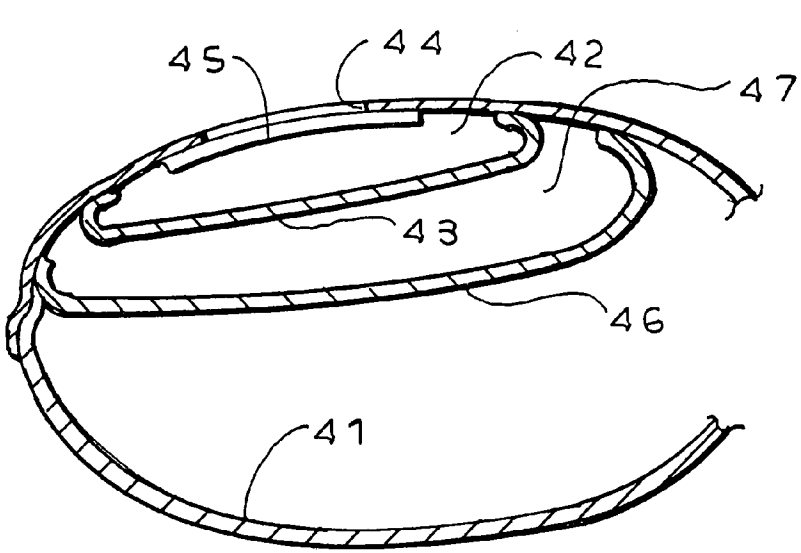
FIG. 4 is a simplified representational cross sectional view as taken generally on line 4—4 of FIG. 1.

The lower portion of the jeans right leg 82 is suitably provided with a decorative patch 86, appropriate to a dollhouse theme, which is secured to the front of the jeans leg material substantially in the manner of the decorative patch 51 shown in FIG. 2. In the instance of FIG. 9, the patch 86 may be in the shape of a house, for example. A carry pouch 87, which can be similar in all structural respects to the carry pouch 50 of FIG. 1, is removably mounted to the lower jeans leg 82 substantially as described in connection with the embodiment of FIG. 1.

The embodiment of FIG. 11 (as well as other embodiments of the invention) advantageously can incorporate removable play pocket features in various forms. In the form illustrated in FIGS. 12, 13, a unit 90, formed of fabric or the like is shaped in the form of a play doghouse and is associated as a package with a play dog or the like 91. The play pocket 90 desirably has an opening 92 therein by which the play element 91 may be inserted between front and back panel elements 93, 94 of the play pocket.

As shown in FIG. 13, the back panel 94 of the play pocket has a plurality of hook and loop type elements 95 arranged for cooperation with corresponding elements 96 attached to the back face of the jeans left leg 71, as shown in FIG. 11. The play pocket thus may be easily attached to and removed from the jeans as desired by the user.

As will be appreciated, the play pockets 90 may come in an endless variety of forms and shapes with various types of play elements 91 associated therewith, and may be changed on a periodic basis by the user.

Referring now to FIGS. 14–20 of the drawings, there is shown a pair of novelty jeans incorporating concealed puppet play features which enable the user, while wearing the jeans, to perform a puppet show display. The reference numeral 100 designates generally children's novelty play jeans having legs 101, 102 incorporating built-in play facilities 103, 104 respectively, advantageously spanning the area of the knees from slightly above to slightly below the position of the user's knees when the jeans are worn. Each of the play facilities is generally in the form of a pocket, which is closed along the bottom 105, 106 and open at the top 107, 108. The respective play facilities 103, 104 advantageously span at least about half way around the respective legs of the jeans 101, 102, embracing the front portions thereof.

Adjacent the upper edge of each of the pockets, there is provided a curtain band 109, 110 which slideably supports a curtain 111, 112. Underneath the curtains, there is advantageously printed or sewed-on decoration 113 depicting a play stage.

The pocket structures of the respective play facilities 103, 104 include not only the top openings 107, 108, but also intermediate openings 114, 115. Secured to the insides of the pocket structures are partial gloves 116, which are normally retained within the pocket structures, but can be projected out through the openings 114, 115 by insertion of the hand into the upper openings 107, 108 of the pockets and then into the partial gloves 116, in the manner indicated in FIG. 20, for example.

Figure 20:
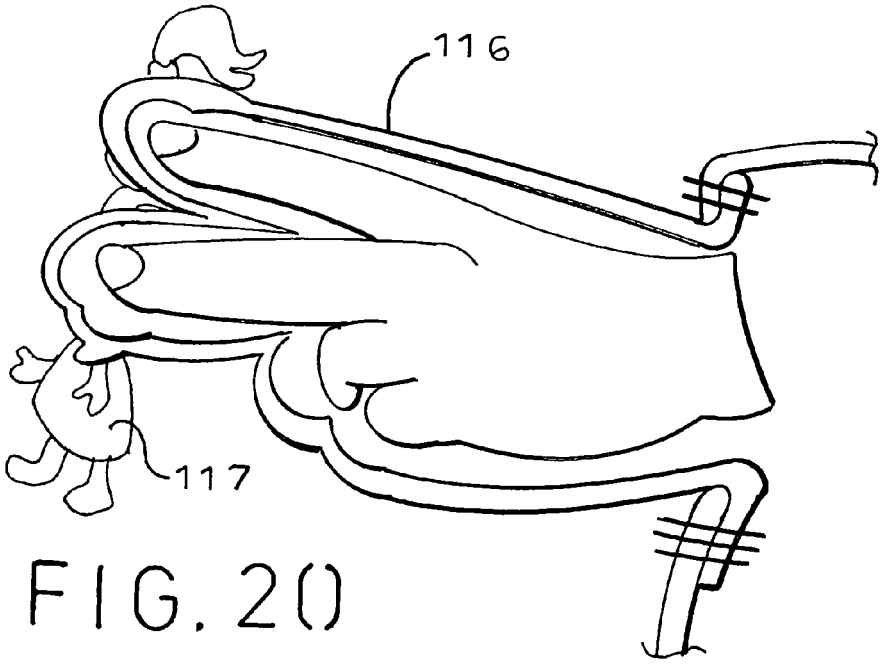
FIG. 20 is an enlarged fragmentary sectional view of the encircled portion of FIG. 19 showing details of the finger puppet feature.

At the outer end extremities of the partial glove 116, there are individual finger puppet elements 117, which can be manipulated by fingers of a hand inserted within the partial glove, as reflected in FIG. 20, for example.

Figure 14:
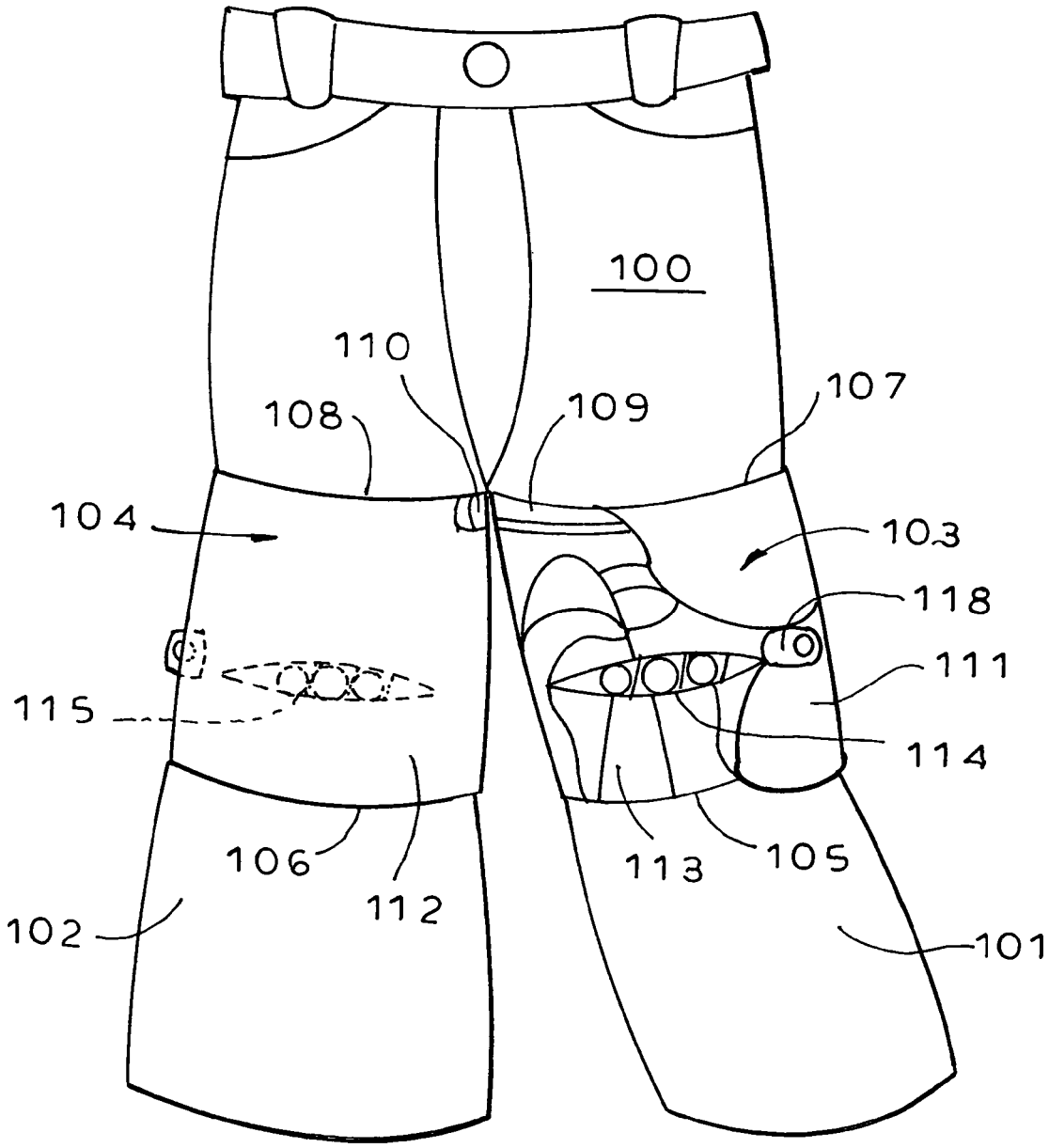
FIG. 14 is a front elevational view of yet another form of the novelty jeans, sometimes referred to herein as puppet show jeans, incorporating features enabling the user to engage in puppet show activities while wearing the jeans.
Figure 15:
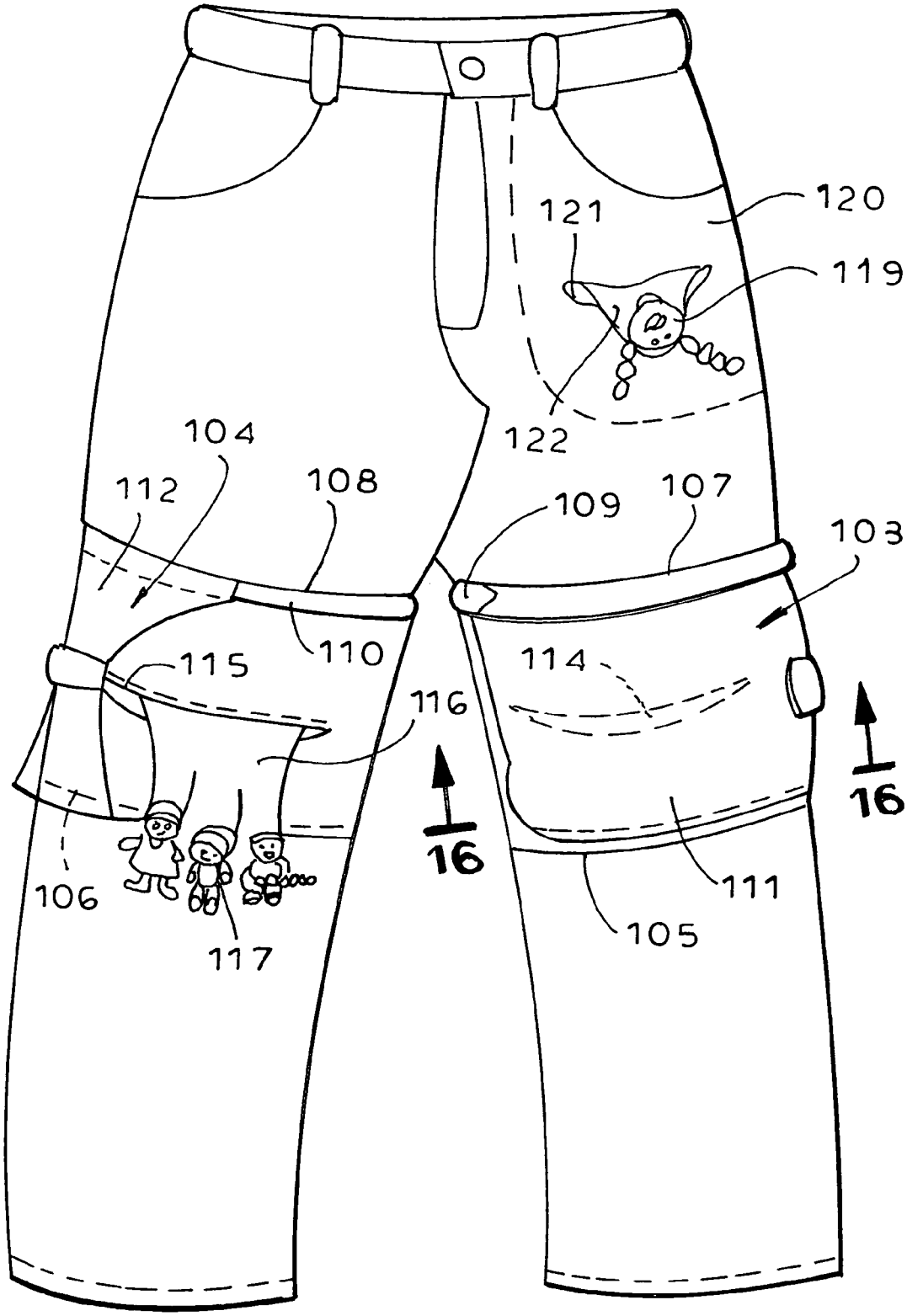
FIG. 15 is a view similar to FIG. 14, showing the jeans in a slightly different activity configuration.
Figure 16:
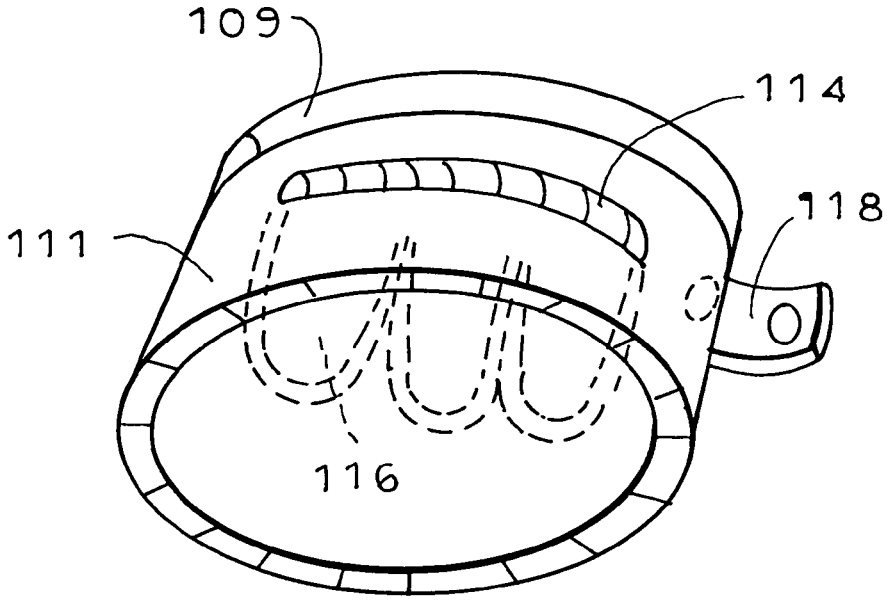
FIG. 16 is a sectional perspective view as taken generally on line 16—16 of FIG. 15, illustrating features of construction of the puppet show feature.
Figure 17:
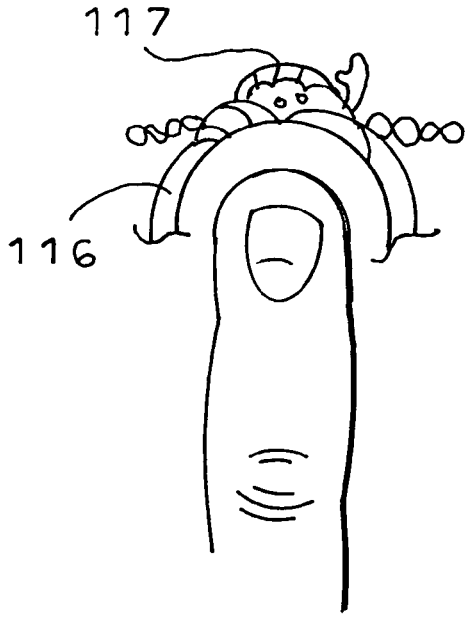
FIG. 17 is an enlarged, fragmentary sectional view illustrating an end portion of a finger puppet device incorporated in the jeans of FIGS. 14, 15.
Figure 18:
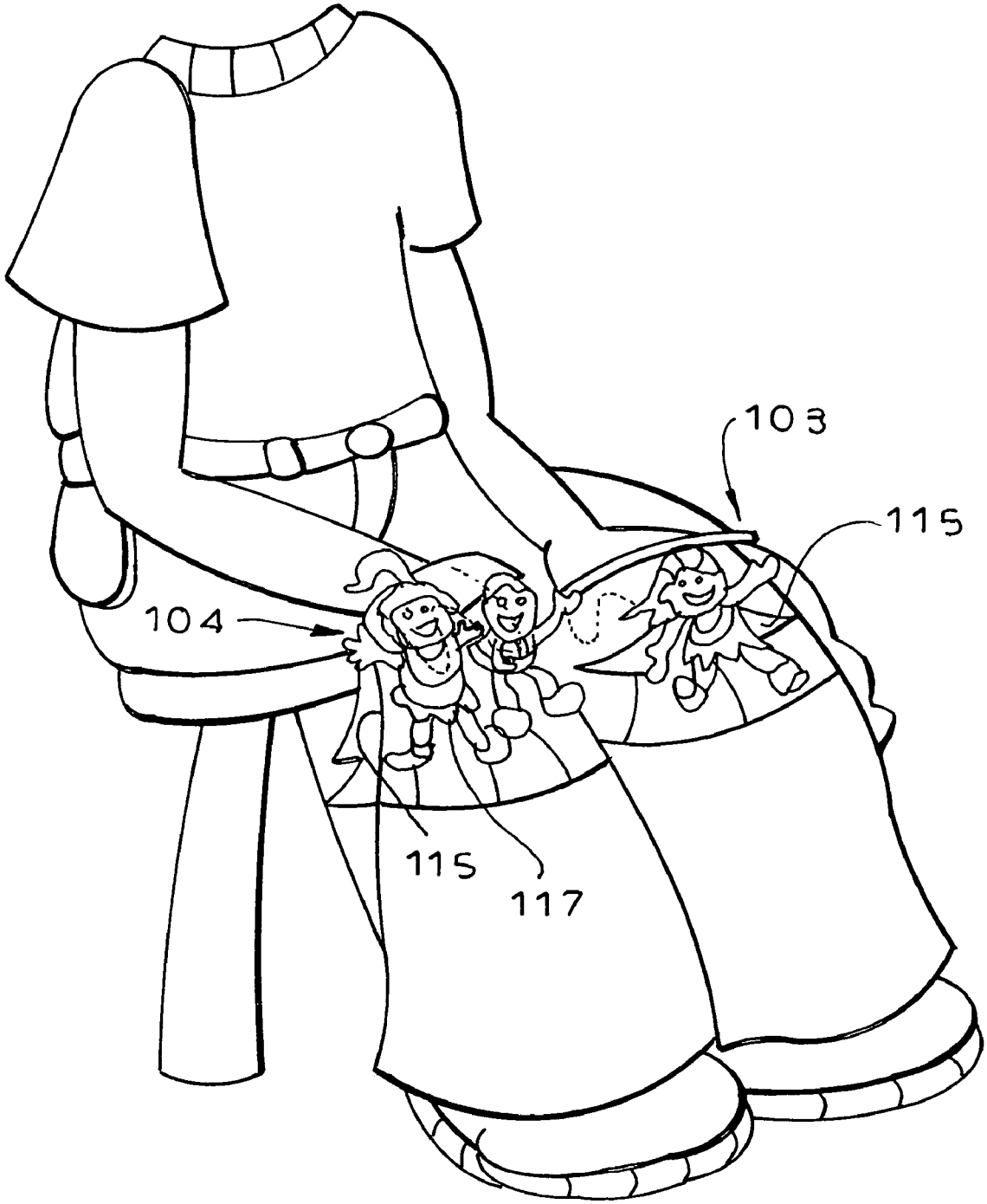
FIG. 18 is a front perspective illustration showing the manner in which the jeans of FIGS. 14, 15 are utilized in play.
Figure 19:
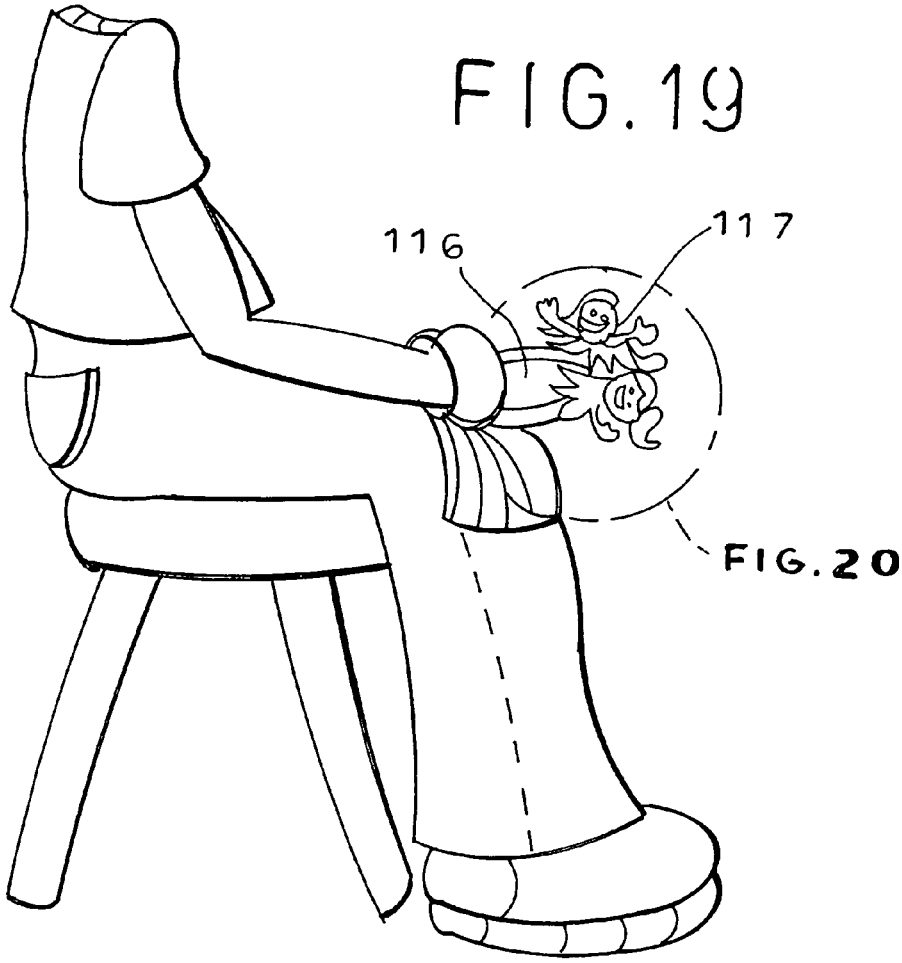
FIG. 19 is a side elevational view of the illustration of FIG. 18.

For normal wear of the jeans, the curtains 111, 112 are normally moved to "closed" positions, as shown at the left in FIG. 14 and at the right in FIG. 15. The partial gloves 116 will have been drawn inwardly through the respective pocket openings 114, 115 and are contained within internal pockets. The user of the jeans can display a puppet show, typically from a seated position as shown in FIGS. 18, 19. For this purpose, the curtains 111, 112 are slid laterally to their respective open positions, where they can be secured by means of a snap together strap arrangement 118 (FIG. 14). The child then inserts one or both hands into the open upper ends 107, 108 of the pocket structures and into the partial gloves 116. The gloves and their respective puppets are projected out through the intermediate pocket openings 114, 115 to display the puppets and enable them to be manipulated in a desired manner.

If desired, a finger puppet 119 may also be provided in connection with an upper pocket 120, projectable through an intermediate pocket opening 121 by a retractable partial glove 122 engagable from inside the pocket.

As will be understood, various of the play features herein described may be mixed and combined in a wide variety of ways to provide attractive, stimulating jeans which incorporate play features usable while the jeans are being worn.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A novelty jeans formed of suitable fabric and which comprises (a) a pair of tubular legs extending from a tubular body portion and having one or more pockets, (b) track-forming means on at least one of the legs forming a defined travel path extending along a front surface portion of said one leg from an upper portion thereof downward substantially to a lower end thereof, and (c) a toy vehicle of a size suitable to be received in a pocket of said jeans and for play travel along said defined travel path, while said jeans are being worn, (d) a panel of fabric disposed generally transversely to said defined travel path and secured to said at least one leg on opposite sides of said travel path, (e) said panel of fabric having a length greater than a width of said travel path and forming a tunnel across said travel path, (f) said tunnel being of such size, in relation to said toy vehicle, as to accommodate passage of said vehicle therethrough.

2. A novelty jeans formed of suitable fabric and which comprises (a) a pair of tubular legs extending from a tubular body portion and having one or more pockets, (b) track-forming means on at least one of the legs forming a defined travel path extending along a front surface portion of said one leg from an upper portion thereof downward substantially to a lower end thereof, and (c) a toy vehicle of a size suitable to be received in a pocket of said jeans and for play travel along said defined travel path, while said jeans are being worn, (d) a laterally oriented pocket disposed in a leg of said jeans, (e) said laterally oriented pocket having a vertically oriented opening and having a pocket pouch adapted to be withdrawn laterally through said opening, (f) an inside surface of said pocket pouch having decorations visible when said pouch is withdrawn through said opening.

3. A novelty jeans formed of suitable fabric and which comprises (a) a pair of tubular legs extending from a tubular body portion and having one or more pockets, (b) track-forming means on at least one of the legs forming a defined travel path extending along a front surface portion of said one leg from an upper portion thereof downward substantially to a lower end thereof, and (c) a toy vehicle of a size suitable to be received in a pocket of said jeans and for play travel along said defined travel path, while said jeans are being worn, (d) one leg of said jeans including a double pocket structure including at least first and second pockets, (e) said first pocket being formed in part by a first fabric of said jeans, (f) said second pocket being located behind said first pocket and extending vertically substantially below said first pocket, (g) said second pocket having a first opening generally behind said first pocket and a second opening adjacent a lower end of said second pocket, whereby a play object may be inserted in an upper end of said second pocket and retrieved through said opening, (h) said first pocket being formed with a window panel forming at least part of a front surface thereof and positioned to at least partially reveal contents of said first pocket.

* * * * *